US005191728A

United States Patent [19]

Paris et al.

[11] Patent Number: 5,191,728

[45] Date of Patent: Mar. 9, 1993

[54] SKI BOOT HAVING A REAR SPOILER, A FRONT CUFF AND A LINKAGE, WHEREIN THE LINKAGE EXTENDS FROM LATERAL SPACED LOCATIONS AT THE SIDES OF THE BOOT TO ANCHORAGE POINTS

[75] Inventors: Jean Paris, Sevier; Claude Perrissoud, Saint-Jorioz, both of France

[73] Assignee: Salomon S.A., Annecy Cedex, France

[21] Appl. No.: 488,975

[22] Filed: Mar. 5, 1990

[30] Foreign Application Priority Data

Mar. 6, 1989 [FR] France ..... 89 02891

[51] Int. Cl.[5] ..... A43B 5/04

[52] U.S. Cl. ..... 36/121; 36/117

[58] Field of Search ..... 36/117, 119, 121, 50, 36/120, 118

[56] References Cited

U.S. PATENT DOCUMENTS

| | | | |
|---|---|---|---|
| 4,160,332 | 7/1979 | Salomon | 36/119 |
| 4,539,763 | 9/1985 | Walkhoff | 36/120 |
| 4,593,483 | 6/1986 | Paris | 36/119 |
| 4,615,127 | 10/1986 | Delery | 36/121 X |
| 4,620,379 | 11/1986 | Sartor | 36/119 |
| 4,644,671 | 2/1987 | Walkhoff | 36/119 |
| 4,653,204 | 3/1987 | Morell et al. | 36/117 |
| 4,660,300 | 4/1987 | Morell et al. | 36/50 |
| 4,670,999 | 6/1987 | Olivieri | 36/119 |
| 4,672,755 | 6/1987 | Benoit et al. | 36/117 |
| 4,748,751 | 6/1988 | Sartor | 36/119 |
| 4,811,503 | 3/1989 | Iwama | 36/50 X |
| 4,893,419 | 1/1990 | Arieh et al. | 36/119 |
| 4,908,965 | 3/1990 | Iwama | 36/119 |
| 4,937,951 | 7/1990 | Loecker | 36/119 |

FOREIGN PATENT DOCUMENTS

| | | |
|---|---|---|
| 2575045 | 6/1986 | France . |
| 8705473 | 9/1987 | World Int. Prop. O. . |

OTHER PUBLICATIONS

Copy of French Search Report.

*Primary Examiner*—Paul T. Sewell
*Assistant Examiner*—BethAnne Cicconi
*Attorney, Agent, or Firm*—Sandler, Greenblum & Bernstein

[57] ABSTRACT

A ski boot, preferably of the rear entry type, having a shell base on which an upper is journalled around an axis. The upper preferably extends towards the rear through two lateral extensions on which the rear spoiler is journalled. The boot includes an inextensible linkage which connect the ends of the axis, while being in contact with the rear spoiler over at least one point spaced from the journal thereof on the shell base. Further, a tensioning device is connected to the linkage which ensures the closure of the boot.

25 Claims, 3 Drawing Sheets

SKI BOOT HAVING A REAR SPOILER, A FRONT CUFF AND A LINKAGE, WHEREIN THE LINKAGE EXTENDS FROM LATERAL SPACED LOCATIONS AT THE SIDES OF THE BOOT TO ANCHORAGE POINTS

BACKGROUND OF THE INVENTION

1. Field of the Invention

The present invention relates generally to ski boots. More particularly, the invention relates to rear-entry boots, formed by a shell base on which an upper is preferably journalled around a transverse axis, the upper including at least one cuff extending towards the rear in the form of two lower lateral extensions and a rear portion journaled on the lateral extensions.

2. Description of Background and Other Information

Boots of the above-mentioned type are described in commonly assigned French Patent Application Publication No. 2,575,045. In that application, the boot is closed on the leg of the skier by means of a cable which ensures that the different parts of the upper are brought together and maintained against the lower leg. With such an arrangement, the upper is intended to perfectly follow the movements of the lower leg, thus ensuring good control of the ski by the skier.

With regard to forces exerted from the front of the boot towards the rear as the skier wears the boot, an abutment arrangement is provided between the rear spoiler and the shell base for limiting the angular displacement of the upper towards the rear with respect to the shell base. In a known manner, these abutments are provided between the cuff of the upper and the shell base.

Other abutment means are often provided between the cuff and the shell base for limiting the forces exerted from the rear towards the front of the boot.

Tests have shown that when the upper is in abutment by the cuff against the shell base, if the skier continues to exert further force through the cuff against the shell base, a deformation of the boot occurs through flexing, or buckling.

This buckling tends to space the two sides of the boot at the location of the transverse journal axis of the upper, i.e., at the position of the ankle of the skier, thus, freeing the ankle of the skier which results in a less than perfect control of the skis through the boots.

SUMMARY OF THE INVENTION

In view of the problems associated with prior known boots as mentioned above, it is an object of the present invention to provide a ski boot including:

(a) a shell base;

(b) an upper mounted for movement with respect to the shell base at two laterally spaced locations, the upper including: (i) at least one cuff; and (ii) a rear spoiler, the rear spoiler mounted for movement with respect to the cuff at a predetermined location of the cuff; and (c) a linkage extending between the two laterally spaced locations and being in contact with the rear spoiler at least one location spaced from the predetermined location of the cuff.

Further according to the invention, a means for tensioning the linkage is provided, wherein the tensioning means is preferably mounted on the rear spoiler at the aforementioned one location of the cuff and connected to the linkage.

The tensioning means is contemplated to be mounted on a portion of the boot spaced from the rear of the boot, including an upper portion of forward portion of the shell base.

In a preferred embodiment of the invention, the tensioning means includes a lever mounted for pivoting on the rear spoiler, wherein movement of the lever toward the rear spoiler is effective to decrease tension of the linkage and movement of the lever away from the rear spoiler is effective to increase tension of the linkage.

According to a particular embodiment of the invention, the linkage includes a single cable which extends through a portion of the tensioning lever.

Alternatively, the linkage includes a pair of cables, each of which extends from a respective one of the two laterally spaced locations and is connected to a portion of the tensioning lever.

Further according to the present invention, the aforementioned portion of the tensioning lever is an adjustment mechanism which is movably mounted relative to the tensioning lever for selectively varying tension in the linkage.

The aforementioned two laterally spaced locations are preferably mounted on the cuff, and the linkage extends from one of a pair of anchorage points on the rear spoiler, to a position proximate a respective one of the two laterally spaced locations on the cuff to a position proximate the predetermined location on the cuff, to the aforementioned one location of the rear spoiler, to a position proximate the other of the two laterally spaced locations on the cuff, and to the other of the pair of the anchorage points. Further, according to a preferred embodiment, the pair of anchorage points are laterally spaced apart.

According to a specific embodiment of the invention, the two laterally spaced locations are on the cuff, wherein the cuff is journalled for movement on the shell base about a first transverse axis, wherein the rear spoiler is journalled for movement with respect to the cuff about a second transverse axis, and wherein the linkage extends from one of a pair of anchorage points on the rear spoiler, around the first axis on one lateral side of the boot, around the second axis on the one lateral side of the boot, to the aforementioned one location of the rear spoiler, around the first axis on a second lateral side of the boot, around the second axis on a second lateral side of the boot, and to the other of the pair of the anchorage points.

According to a still further aspect of the invention, the cuff and the shell base each include an abutment portion which mutually engage upon a predetermined amount of movement of the cuff relative to the shell base. In one embodiment, the abutment portions are provided on respective rear portions of the cuff and the shell base. In another embodiment, the abutment portion of the cuff is provided on a forward portion of the cuff.

Still further according to the invention, the linkage further extends from each of the two laterally spaced to a respective one of two anchorage points located on the rear spoiler.

More specifically, each of the anchorage points is one of a plurality of anchorage points located on a respective lateral side of the rear spoiler, and the linkage includes a pair of ends having means for selectively locating a respective one of the ends of the linkage in one of the plurality of anchorage points on a respective lateral side of the rear spoiler.

The upper of the ski boot can include a front spoiler which is movably mounted relative to the cuff. In such an embodiment, means are provided for closing the front spoiler relative to the cuff.

In another aspect of the invention, the ski boot can include means for adjusting the magnitude of flexion of the upper relative to the shell base.

It is a further object of the present invention to provide a ski boot including:

(a) a shell base having an upper journalled on the shell base around a first transverse axis at two laterally spaced locations, the upper including:
  (i) at least one cuff having two rearwardly extending lateral extensions; and
  (ii) a rear spoiler, the rear spoiler being journalled on the lateral extensions around a second transverse axis; and
(b) an inextensible means extending between the two laterally spaced locations and being in contact with the rear spoiler at least one location spaced from the second transverse axis.

According to a further aspect of an invention, a means for tensioning the inextensible means is provided, the inextensible means being connected to the tensioning means, wherein the tensioning means is mounted for movement relative to the remainder of the boot to facilitate closure of the boot during a predetermined movement of the tensioning means.

Further according to the invention, the inextensible means are formed by (i) at least two portions of a linkage positioned between the first transverse axis and anchorage points located on the rear spoiler and (ii) a portion of the linkage on the rear spoiler between the anchorage points.

According to a still further aspect of the invention, each of the anchorage points is on one side of the boot.

Still further according to the invention, the tensioning means includes a tensioning lever mounted on the rear spoiler, the linkage has a pair of ends which are anchored at two anchorage points on the rear spoiler, and the linkage surrounds the first transverse axis and the second transverse axis and is connected to the tensioning lever.

In a particular embodiment of the invention, a plurality of anchorage points located on at least one side of the boot, whereby the linkage is selectively positionable with respect to the plurality of anchorage points.

Preferably, according to the invention, the tensioning means includes a tensioning lever mounted on the rear spoiler, and the linkage connects each of the laterally spaced locations on the first transverse axis and the tensioning lever.

BRIEF DESCRIPTION OF THE DRAWINGS

Additional objects, characteristics, and advantages of the present invention will become apparent with reference to the annexed drawings which illustrate, by way of non-limiting examples, various embodiments of the ski boot according to the invention, in which.

DETAILED DESCRIPTION OF THE PREFERRED EMBODIMENTS

The present invention proposes an effective solution to the problems mentioned above with regard to the prior art which, additionally, is relatively easy to put into effect.

To this end, the present invention has, as one object, a ski boot of the rear-entry type formed by a shell base on which an upper is journalled around a transverse axis, the upper including at least one cuff extending towards the rear by two lateral lower extensions and a rear portion journaled on the lateral extensions, wherein an inextensible means, such as a cable, connect the ends of the transverse axis between the journals, while being at least in contact with the rear portion of the upper at least one point spaced from the journal of the rear portion on the cuff.

In a preferred manner, the inextensible means likewise ensures the closure of the boot while being connected, in a manner known per se, to a tensioning device, such as a lever, which can be freed to allow for the spacing of the rear portion with respect to the cuff when the skier inserts or removes his or her boot.

The inextensible means, according to the invention, are preferably formed by two portions of a linkage positioned between the ends of the transverse axis between the journals and an anchor point positioned at each of the sides of the rear portion and, by the portion of the rear portion included between the anchorage points.

The linkage which is thus positioned maintains a constant tension, whatever the force applied by the skier to the boot, which is not the case with linkages of the type known to wind around the shell base and the upper to ensure the closure of the boot.

Figure 1:
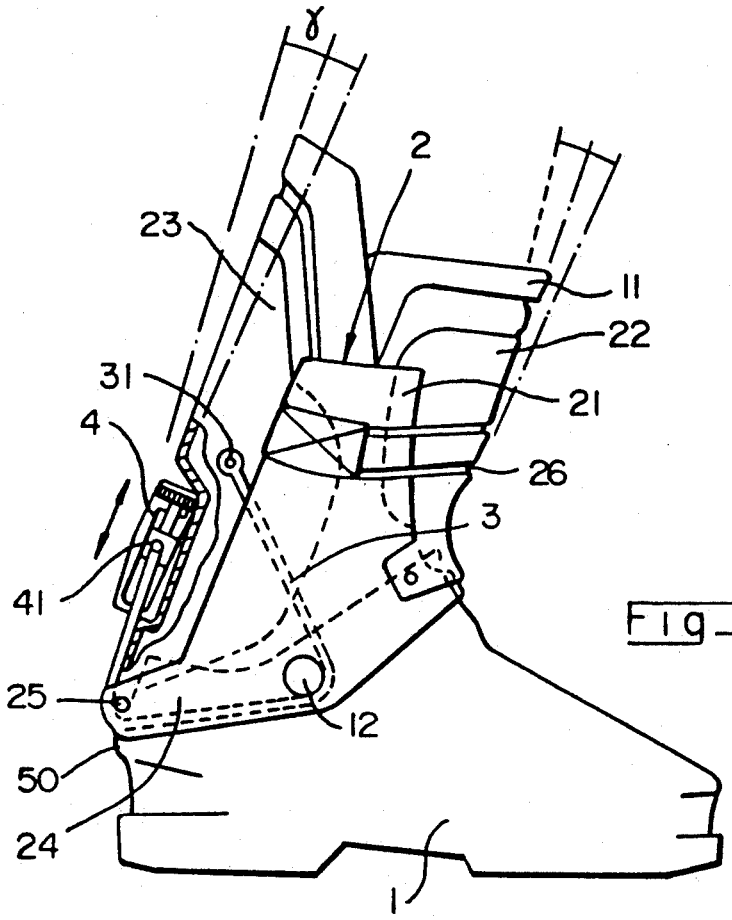
FIG. 1 illustrates a first embodiment of the invention.

The boot illustrated in FIG. 1 is formed by a shell base 1 on which the upper 2 is journaled. In this embodiment, the upper comprises three portions: the cuff 21 journaled around the transverse axis 12 of the shell base, a front spoiler 22, and a rear portion 23.

The rear portion 23, often referred to as a rear spoiler or simply a spoiler, is mounted on lateral extension 24 of cuff 21, around an axis 25. Further, in the usual manner, a liner 11 is introduced within the boot.

When the upper 2 comprises three portions, as shown in FIG. 1, the front spoiler 22 is journaled at its lower portion on the cuff and is maintained with respect to the cuff in its upper portion by a cable 26, which functions to ensure closure of the front of the boot on the lower leg.

In the normal manner, along the transverse journal axis 12, rivet assemblies are provided for pivotally connecting the cuff and shell base. The transverse axis 12 coincides approximately with the ankle joint of the skier.

As shown in FIG. 1, an inextensible linkage 3 is anchored at its two ends on each lateral side of the rear spoiler 23 at point 31, one of which is visible in the figure.

The linkage 3 extends around each of the rivet assemblies at the ends of a segment of the transverse axis 12, then around the journal axes 25 of the rear spoiler on the cuff, before being connected to a threaded ring 41 of a tensioning lever 4, which is connected to the rear spoiler 23. The linkage preferably extends through an opening in the ring 41.

The inextensible or unstretchable linkage 3 which, according to the invention, connect the rivet assemblies on opposite sides of the boot at transverse axis 12, are here formed by the two linkage portions positioned on opposite lateral sides of the boot, which extend between the axis 12 and a respective anchorage point 31 of the linkage on the rear spoiler 23, and by a portion at the rear spoiler 23 situated both between the anchorage points 31 and between the rivet assemblies.

When the tensioning device 4, as shown, is in the position for which the linkage 3 is under tension, the closure of the boot is ensured.

The anchorage points 31, preferably and as shown, are spaced from the journal axis 25 such that the tension of the linkage 3 is applied to the rear spoiler 23 with a substantial lever arm effect with respect to the axis of rotation 25 of the rear spoiler. Such a mounting configuration makes it possible to ensure that the rear spoiler 23 is always subjected to a tensioning action to make it pivot forwardly, so that it is always perfectly supported against the lower leg of the skier.

The threaded ring 41 of the tensioning device 4, to which in the embodiment shown an intermediate portion of the linkage 3 is connected, can be selectively adjusted along the length of the tensioning device. Thus, by adjusting the position of threaded ring 41 along the tensioning device 4, the skier is able to modify the length of the linkage portions situated between the axis 12 and the anchorage points 31. The skier can thus adjust, as desired, the inclination angle of the rear spoiler 23 with respect to the shell base, the adjustment of the upper 2 on the lower leg of the skier being then achieved by the tightening of cable 26, ensuring the positioning of the front spoiler 22 with respect to cuff 21. The limit of rearward displacement of cuff 21 with respect to the shell base 1 is here ensured by the engagement from the rear of cuff 21 on abutment 50 provided at the rear of the shell base.

If the boot were not provided with means according to the present invention, the boot would be deformed by buckling if the skier were to exert a further force after the cuff engages against abutment 50. Such deformation would develop at the upper rear of the cuff and toward the front end of the shell base and would have a maximum magnitude near the transverse axis 12 since, on the one hand, it is the journal point of the cuff on the shell base and, on the other hand, it is the portion at which, transversely, the boot is the least rigid.

It is for this reason, according the invention, that the linkage 3 is positioned in a manner to connect the axis 12 between the rivet assemblies so as to prevent the journal points from becoming separated from one another and, thus, to prevent buckling of the boot.

Further, the linkage 3 prevents the occurrence of any buckling which would occur when the cuff 21 abuts against the shell base 1 as a result of prolonged forces directed from the rear to the front.

The journal points along axis 12 thus remain under all circumstances separated by a predetermined distance, maintaining the position of the ankle of the skier at any moment under proper conditions.

For the insertion and removal of the foot with respect to the boot, the skier frees the tension on linkage 3 by acting on tensioning device 4, after which the skier can then pivot the rear spoiler towards the rear.

Figure 2:
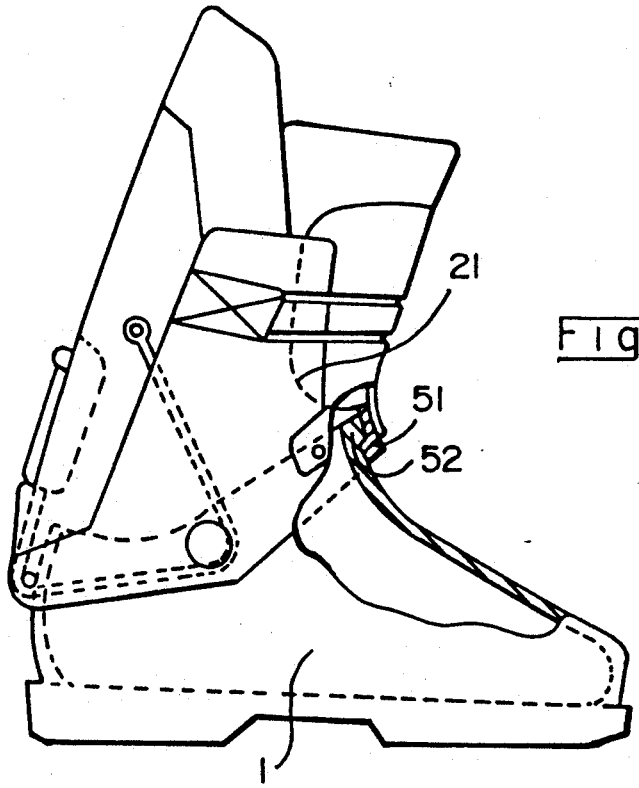
FIG. 2 illustrates the same embodiment of the invention as illustrated in FIG. 1, but depicts a boot having a different abutment means.

In the example of FIG. 2, an embodiment of the abutment means between cuff 21 and shell base 1 is shown which uses complementary shapes 51 and 52 of the lower front edge of cuff 21 and of the upper front edge of shell base 1. In such an embodiment, the rear of the cuff does not abut against the rear of the shell base.

Figure 3:
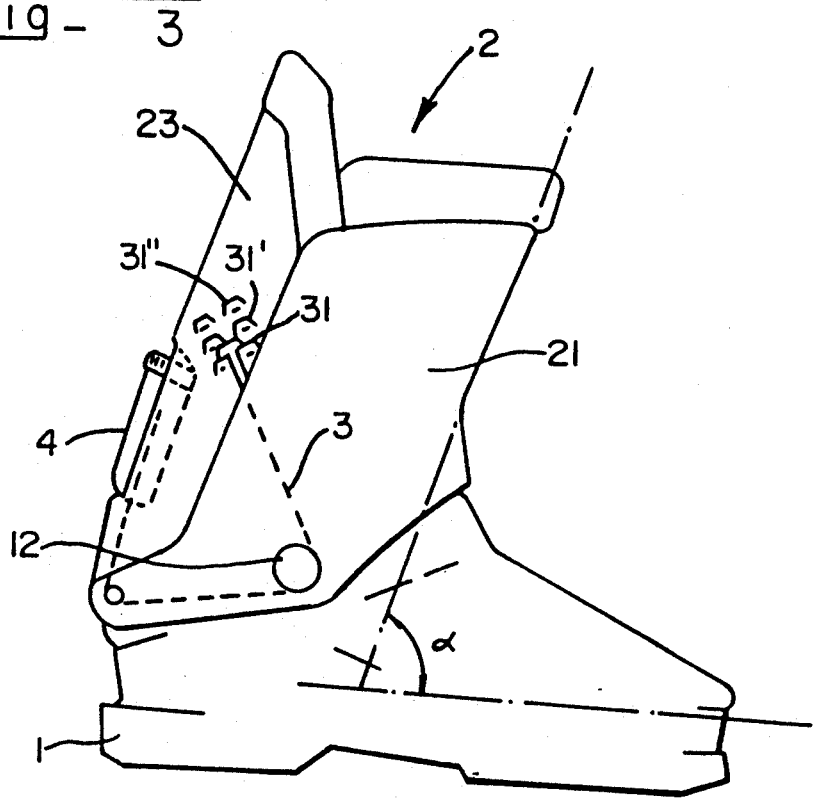
FIGS. 3, 4, 5, and 6 illustrate four additional embodiments of the invention.

In the embodiment of FIG. 3, upper 2 does not comprise a front spoiler, but is formed only by cuff 21 which is then closed towards the front. According to this embodiment of the present invention, linkage 3 follows a path similar to that of the aforementioned embodiments of FIGS. 1 and 2, but the adjustment of its length and, thus, the adjustment of the advancement angle $\alpha$ (alpha), defined between the front of the cuff 21 and the horizontal, is accomplished in a different manner.

The boot of FIG. 3 has on at least one of its sides, and preferably on both sides, a plurality of points 31, 31', 31" from which the skier can select to anchor the ends of linkage 3, the tension lever 4 being able to ensure the tension of the linkage 3. The points 31, 31', 31" are preferably defined by respective abutments which are engaged by an enlargement on a respective linkage end 3, as shown in FIG. 3.

In FIGS. 1-3, linkage 3 is formed as a single cable anchored at its respective ends on the rear spoiler and maintained at an intermediate portion on the tensioning device 4. However, one can, without going beyond the scope of the invention, position a single cable with its two ends hooked to the tensioning device 4, and an intermediate portion surrounding the rear of the rear spoiler 23 while being guided at least one point on the rear spoiler. It is assumed in such an embodiment that the anchorage points 31 are coincident at a single point. Further, the cable 26 could include a boot-closing buckle.

The linkage 3 can likewise be formed from two cables each connecting the tensioning lever 4 to an anchorage point 31 on the rear spoiler.

Figure 4:
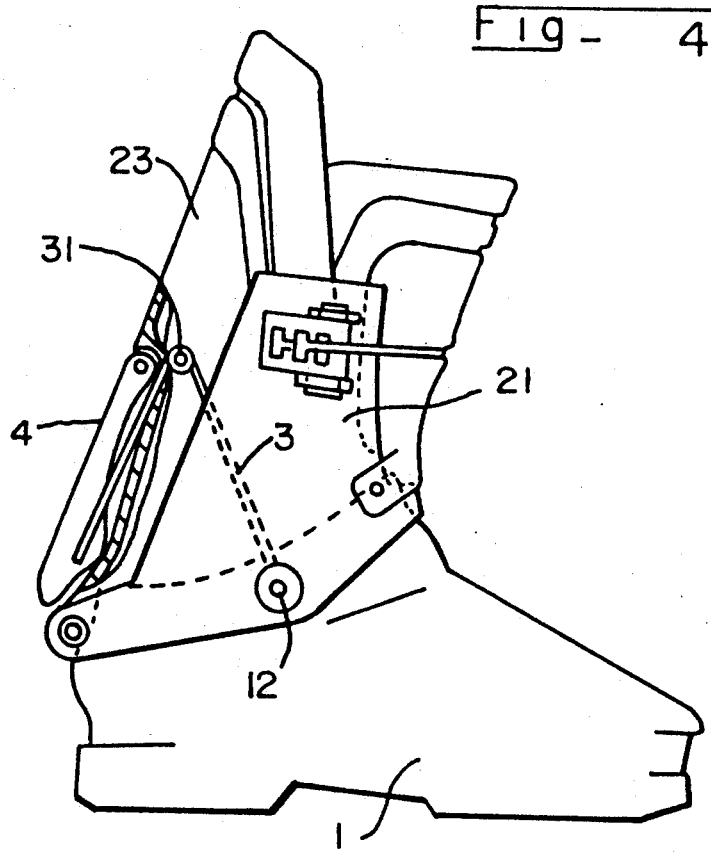

FIG. 4 illustrates an alternative embodiment according to which the linkage 3 is shorter, only its useful portion between the ends of axis 12 and the anchorage points 31 on the rear spoiler 23 and its connection to a tensioning lever 4 being preserved.

It is understood that the tensioning lever 4 must here be moved downwardly to ensure the tensioning of linkage 3 instead of being moved upwardly as in the case of the embodiments of FIGS. 1-3.

Figure 5:
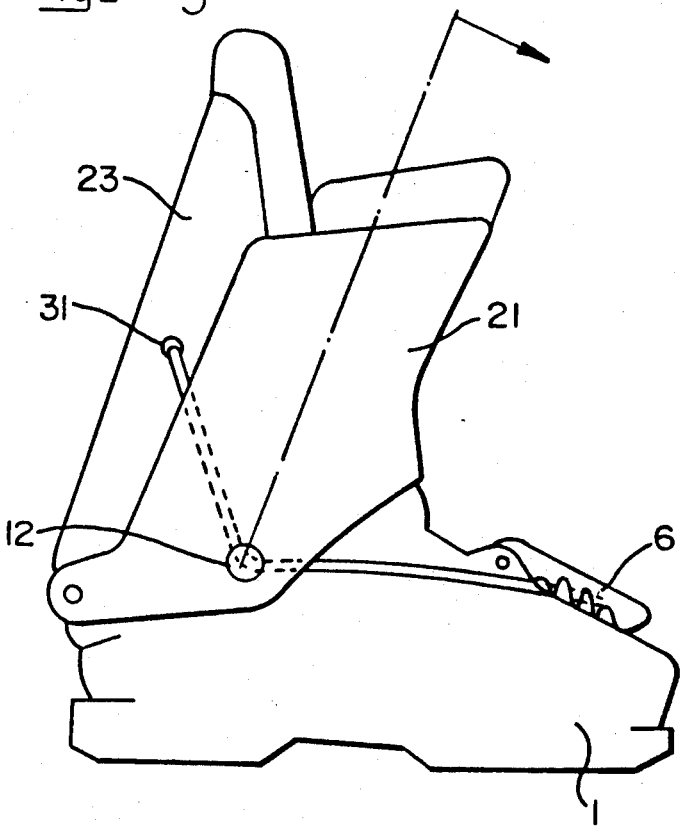
Figure 6:
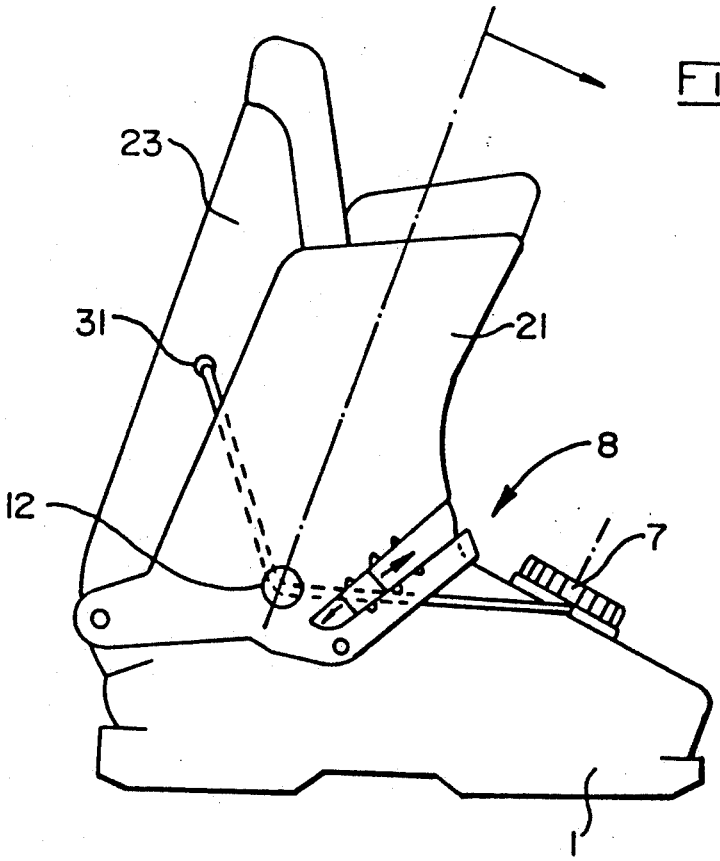

According to the embodiments of FIGS. 5 and 6, the tensioning lever is provided on the front portion of shell base 1 instead of being connected to the rear spoiler 23, as in the case of the previously described embodiments.

In FIG. 5, the tensioning lever 6 is a toothed lever of a type often utilized on ski boots. The amount of tensioning force can be varied by selectively placing the linkage 3 in respective ones of the teeth of the lever 6, before the lever is pivoted to the position shown in FIG. 5. In FIG. 6, a winder 7 is shown in which the linkage cable is wound around a spool which can be selectively turned to vary the tension of the linkage cable.

In FIG. 6, there is also shown, in a schematic manner, a means 8 for adjusting the amplitude of flexion of the upper, which can be embodiment in the present invention. As arranged in a known manner, a cursor is selectively movable along a slot provided in the forward portion of the front cuff or spoiler to effect the nature of the flexion as forces are directed thereupon by the skier during the course of skiing.

In all of the embodiments shown, the linkage 3 is engaged between the external surface of the rear spoiler 23 and the internal surface of cuff 21, as well as between the internal surface of cuff 21 and the external surface of shell base 1.

The invention is contemplated to be used with any variation of the ski boots shown and described herein. Known elements, such as a front spoiler or an adjustment means for adjusting the magnitude of flexion not having anything specifically to do with the operation of the linkage are optional.

The tension adjusting devices 4, 6, and 7 have been shown in the embodiments above outside of the portions connecting the ends of axis 12 to rear spoiler 23. However, it would not be beyond the scope of the invention to position them between the anchorage points 31 and the ends of transverse axis 12. Further; although the linkage 3 has been referred to hereinabove as being inextensible, it is contemplated that the term "inextensible" includes "substantially inextensible" as well.

Although the invention has been described with reference to particular means, materials and embodiments, the invention is not limited to the particulars disclosed and extends to all equivalents within the scope of the claims.

What is claimed is:

1. A ski boot comprising:

(a) a shell base having an upper journalled on said shell base around a first transverse axis at two laterally spaced locations, said upper comprising:

(i) at least one cuff having two rearwardly extending lateral extensions; and (ii) a rear spoiler, said rear spoiler being journalled on said lateral extensions around a second transverse axis, said second transverse axis being spaced apart from said first transverse axis, said rear spoiler comprising anchorage points for said linkage, said anchorage points being located on respective opposite sides of the boot;

(b) an inextensible means extending between said two laterally spaced locations and being in contact with said rear spoiler at at least one location spaced from said second transverse axis, said inextensible means being formed by:

(i) at least two portions of a linkage positioned between said first transverse axis and said anchorage points located on said spoiler; and (ii) a portion of said linkage on said rear spoiler between said anchorage points; and (c) means for tensioning said inextensible means comprising a tensioning lever mounted on said rear spoiler, wherein said linkage has a pair of ends which are anchored at a respective one of said anchorage points on said rear spoiler, and wherein said linkage extends around said first transverse axis and is connected to said tensioning lever.

2. A ski boot according to claim 1, further comprising a plurality of anchorage points located on at least one side of the boot, whereby said linkage is selectively positionable with respect to said plurality of anchorage points.

3. A ski boot according to claim 1, wherein said tensioning means comprises a tensioning lever mounted on said rear spoiler, wherein said linkage connects each of said laterally spaced locations on said first transverse axis and said tensioning lever.

4. A ski boot according to claim 1, wherein said tensioning means are located on a rear portion of the boot.

5. A ski boot comprising:

(a) a shell base having an upper journalled on said shell base around a first transverse axis at two laterally spaced locations, said upper comprising:

(i) at least one cuff having two rearwardly extending lateral extensions; and (ii) a rear spoiler, said rear spoiler being journalled on said lateral extensions around a second transverse axis, said second transverse axis being spaced apart from said first transverse axis, said rear spoiler comprising anchorage points for said linkage, said anchorage points being located on respective opposite sides of said boot;

(b) an inextensible means extending between said two laterally spaced locations and being in contact with said rear spoiler at at least one location spaced from said second transverse axis, said inextensible means being formed by:

(i) at least two portions of a linkage positioned between said first transverse axis and said anchorage pointed located on said rear spoiler; and (ii) a portion of said linkage on said rear spoiler between said anchorage points;

(c) a means for tensioning said inextensible means, said inextensible means being connected to said tensioning means, wherein said tensioning means is mounted for movement relative to the remainder of the boot to facilitate closure of the boot during a predetermined movement of said tensioning means, said tensioning means comprising a tensioning lever mounted on said rear spoiler, wherein said linkage has a pair of ends which are anchored at a respective one of said anchorage points on said rear spoiler, and wherein said linkage extends around said first transverse axis and said second transverse axis and is connected to said tensioning lever.

6. A ski boot according to claim 5, further comprising a plurality of anchorage points located on at least one side of the boot, whereby said linkage is selectively positionable with respect to said plurality of anchorage points.

7. A ski boot according to claim 5, wherein said tensioning means comprises a tensioning lever mounted on said rear spoiler, wherein said linkage connects each of said laterally spaced locations on said first transverse axis and said tensioning lever.

8. A ski boot according to claim 5, wherein said tensioning means are located on a rear portion of the boot.

9. A ski boot comprising:

(a) a shell base;

(b) an upper mounted for movement with respect to said shell base at two laterally spaced locations, said upper comprising:

(i) at least one cuff; and (ii) a rear spoiler, said rear spoiler mounted for movement with respect to said cuff at a predetermined location of said cuff, distinct from said two laterally spaced locations; and (c) means for connecting said rear spoiler and said at least one cuff, comprising a linkage extending between said two laterally spaced locations and extending to said rear spoiler at at least one location spaced from said predetermined location of said cuff, wherein said two laterally spaced locations are at said cuff, wherein said cuff is journalled for movement on said shell base about a first transverse axis, wherein said rear spoiler is journalled for movement with respect to said cuff about a second transverse axis, and wherein said linkage extends from one of a pair of anchorage points on said rear spoiler, around said first axis on one lateral side of the boot, around said second axis on said one lateral side of the boot, to said first axis on a second lateral side of the boot, around said second axis on a second lateral side of the boot, and to the other of said pair of said anchorage points.

10. The ski boot of claim 9, further comprising a means for tensioning said linkage, wherein said tensioning means is mounted on said rear spoiler at said one location of said cuff and connected to said linkage.

11. The ski boot of claim 10, wherein said tensioning means comprises a lever mounted for pivoting on said rear spoiler, wherein movement of said lever toward said rear spoiler is effective to decrease tension of said linkage and movement of said lever away from said rear spoiler is effective to increase tension of said linkage.

12. The ski boot of claim 11, wherein said linkage comprises a single cable which extends through a portion of said tensioning lever.

13. The ski boot of claim 12, wherein said portion of said tensioning lever is an adjustment mechanism which is movably mounted relative to said tensioning lever for selectively varying tension in said single cable.

14. The ski boot of claim 11, wherein said linkage comprises a pair of cables, each of which extends from a respective one of said two laterally spaced locations and is connected to a portion of said tensioning lever.

15. The ski boot of claim 14, wherein said portion of said tensioning lever is an adjustment mechanism which is movably mounted relative to said tensioning lever for selectively varying tension in said single cable.

16. The ski boot of claim 9, wherein said pair of anchorage points are laterally spaced apart.

17. The ski boot of claim 9, wherein said two laterally spaced locations are on said cuff.

18. The ski boot of claim 9, wherein said cuff and said shell base each comprise an abutment portion which mutually engage upon a predetermined amount of movement of said cuff relative to said shell base.

19. The ski boot of claim 18, wherein said abutment portions are provided on respective rear portions of said cuff and said shell base.

20. The ski boot of claim 18, wherein said abutment portion of said cuff is provided on a forward portion of said cuff.

21. The ski boot of claim 9, wherein said linkage extends from each of said two laterally spaced locations to a respective one of said two anchorage points located on said rear spoiler.

22. The ski boot of claim 21, wherein each of said anchorage points is one of a plurality of anchorage points located on a respective lateral side of said rear spoiler, and wherein said linkage includes a pair of ends having means for selectively locating a respective one of said ends of said linkage in one of said plurality of anchorage points on a respective lateral side of said rear spoiler.

23. The ski boot of claim 22, wherein said upper further comprises a front spoiler which is movably mounted relative to said cuff.

24. The ski boot of claim 23, further comprising means for closing said front spoiler relative to said cuff.

25. The ski boot of claim 9, further comprising means for adjusting the magnitude of flexion of said upper relative to said shell base.

* * * * *